US007713327B2

(12) United States Patent
Engström et al.

(10) Patent No.: US 7,713,327 B2
(45) Date of Patent: May 11, 2010

(54) TOOL FOR COLDFORMING OPERATIONS WITH IMPROVED PERFORMANCE

(75) Inventors: Håkan Engström, Bromma (SE); Luis Miñarro i Bruguera, Barcelona (ES); Emmanuel Pauty, Echirolles (FR); Vasco i Salas, Barcelona (ES)

(73) Assignee: Sandvik Intellectual Property AB, Sandviken (SE)

( * ) Notice: Subject to any disclaimer, the term of this patent is extended or adjusted under 35 U.S.C. 154(b) by 412 days.

(21) Appl. No.: 11/440,425

(22) Filed: May 25, 2006

(65) Prior Publication Data

US 2006/0272448 A1 Dec. 7, 2006

(30) Foreign Application Priority Data

May 27, 2005 (SE) ..... 0501201
Oct. 17, 2005 (SE) ..... 0502290

(51) Int. Cl.
*C22C 29/08* (2006.01)
*B21D 22/20* (2006.01)

(52) U.S. Cl. ..... 75/240; 72/347; 72/467

(58) Field of Classification Search ..... 75/240; 72/347, 379.4, 467
See application file for complete search history.

(56) References Cited

U.S. PATENT DOCUMENTS

| | | | | |
|---|---|---|---|---|
| 2,133,867 | A | 10/1938 | Lucas | |
| 3,514,818 | A | 6/1970 | Meadows | |
| 4,148,208 | A * | 4/1979 | Maeder | 72/342.4 |
| 4,820,482 | A * | 4/1989 | Fischer et al. | 419/15 |
| 5,009,705 | A * | 4/1991 | Yoshimura et al. | 75/240 |
| 5,095,730 | A | 3/1992 | Lauder | |
| 5,396,788 | A | 3/1995 | Dziedzic et al. | |
| 5,736,658 | A * | 4/1998 | Mirchandani et al. | 75/236 |
| 5,773,735 | A | 6/1998 | Dubensky et al. | |
| 5,882,376 | A | 3/1999 | Kim et al. | |
| 5,918,102 | A * | 6/1999 | Friederichs | 419/15 |
| 5,948,523 | A | 9/1999 | Carpenter et al. | |
| 6,086,650 | A | 7/2000 | Carpenter | |
| 6,402,802 | B1 | 6/2002 | Bhagat | |
| 6,464,748 | B2 | 10/2002 | Perez et al. | |
| 6,793,875 | B1 * | 9/2004 | Shaw et al. | 419/18 |
| 2002/0031440 | A1 | 3/2002 | Grearson et al. | |
| 2002/0059849 | A1 | 5/2002 | Perez et al. | |
| 2005/0129951 | A1 * | 6/2005 | Collin et al. | 428/408 |
| 2006/0272449 | A1 | 12/2006 | Engstrom et al. | |

FOREIGN PATENT DOCUMENTS

| | | | |
|---|---|---|---|
| JP | 04-128330 | | 4/1992 |
| JP | 4-128330 | * | 4/1992 |

OTHER PUBLICATIONS

A.M. Massai et al. "Scientific and technological process in the filed of steel wire drawing." *Wire*. Jun. 1999, pp. 36-40.
A. M. Massai et al. "Scientific and Technological Progress in the Field of Steel Wire Drawing ," *Wire*, Jun. 1999, pp. 36-40.
Pauty et al., U.S. Appl. No. 12/003,202 entitled "Corrosion Resistant Tool" filed Dec. 20, 2007.
Jianghong Gong et al. "Analysis of the indentation size effect on the apparent hardness for ceramics",*Materials Letters 38* (1999), pp. 197-201.
"Hardmetals—Vikers hardness test", International Standard ISO 3878, *International Organization for Standardization*, Second Edition, 1983, Ref. No. ISO 3878-1983 (E), pp. 1-4.
"Metallic materials—Vickers hardness test—Part 1: Test Method (ISO 6507-1:2005)", Svensk Standard SS-EN ISO 6507-1:2006, *Swedish Standards Institute*, Feb. 2006, pp. 1-19 (in English).

* cited by examiner

*Primary Examiner*—Roy King
*Assistant Examiner*—Ngoclan T Mai
(74) *Attorney, Agent, or Firm*—Drinker Biddle & Reath LLP

(57) ABSTRACT

The present invention relates to a cemented carbide tool for the deep drawing operations, especially as the ironing dies, of the manufacturing of aluminum or steel beverage cans. The cemented carbide comprises WC with an ultra fine grain size, a binder phase of Co, and grain growth inhibitors (V and/or Cr), wherein the Co content is from about 5 to about 10 wt-%, and with a specific relation between HV30 and cobalt content.

24 Claims, 1 Drawing Sheet

TOOL FOR COLDFORMING OPERATIONS WITH IMPROVED PERFORMANCE

BACKGROUND OF THE INVENTION

The present invention relates to a method of making improved cemented carbide tools for shaping or otherwise working materials. The invention has particular application in making metal working tools, and specifically tools used in the manufacture of tubular casings and similar articles, such as two-piece beverage cans.

A two-piece can is made by a drawing and wall ironing process. In general, a two-piece can is made by stamping out metal discs from a metal plate. A metal "cup" is formed from the disk. The formed cups are pushed through a body-forming die comprising a plurality of annular rings, generally known as draw, redraw, and ironing rings, by a body-forming punch. The clearances between the body-forming punch and the plurality of rings become progressively smaller, so that the thickness of cup wall is reduced and the cup is elongated. This process is generally referred to as the ironing operation. It is a particularly demanding operation causing high wear on the tools and the operation is sensitive to the dimensional changes and lubrication conditions. Because of the tremendous volume of beverage cans manufactured each year, each slight improvement in the manufacturing process can result in tremendous savings.

Tools for imparting a desired shape, form, or finish to a material, such as dies, punches, and the like, must be characterized by extreme hardness, compressive strength and rigidity. This is particularly necessary when shaping metals or similar materials. Commercial material working tools for mass production must also be resistant to wear, erosion and chipping from repeated and continuous stress and abrasion. These tools must also be made from materials which can be designed and machined to close tolerances and maintain dimensional stability over a wide range of operating conditions.

It is known to make punches, dies, deep draw tooling and similar material working tools from a variety of materials, including metals, cemented carbide and conventional ceramics. These known materials all have certain undesirable limitations. When making tools for shaping metal articles, particularly tubular casings such as two-piece beverage cans, the problems of prior known materials becomes particularly significant.

In the 1980's a grade having only 3 wt-% binder and ultra fine grain size for tire cord drawing was introduced by Sandvik. It was later withdrawn due to the low strength and brittle behaviour leading to premature failures.

In a European project, Wireman, (reported by A. M. Massai et al, "Scientific and technological progress in the field of steel wire drawing", Wire 6/1999), the conditions for drawing of tire cord were investigated. New cemented carbide grades were tested in the grain size range of 0.3-1 μm and a binder content of 0.3-5 wt-%. A hardness increase was achieved by reducing the binder content and decreasing the grain size of WC. According to published results, the grades did not completely satisfy the expectation on better performance, despite the high hardness achieved. The conclusion quotes: "The wear tests demonstrated that not only the hardness of the dies controls the die wear mechanism."

According to the prior art, a possible way to achieve better performance in can manufacturing is the use of ceramic materials, e.g. whisker reinforced alumina or silicon nitride as disclosed in U.S. Pat. No. 5,095,730 and U.S. Pat. No. 5,396, 788 respectively, but so far conventional cemented carbide seems to keep its position as the preferred material.

The present invention relates to the recent development of ultra fine grained cemented carbide.

During many years there has been an ongoing development of cemented carbide with finer and finer grain size. The extension of cemented carbide grain sizes into the ultra fine size range leads to a number of positive improvements regarding the wear processes.

Attrition wear (or grain loss volume) may be reduced by an order of magnitude by little more than halving the sintered grain size (in the absence of other wear processes), since grain volume is related to the cube of diameter.

Adhesive fracture is another dangerous kind of attrition wear, in which the separation of strongly welded tool-work-material interfaces can induce tensile cleavage within the underlying carbide. Ultra fine hardmetals can resist the onset of such fractures better than coarser ones due to their greater rupture strength.

Erosion/corrosion of the binder phase is said to be part of the wear mechanism in wire drawing and the deep drawing of beverage cans. In ultra fine cemented carbide, even though the content of binder is maintained or even increased compared to conventional cemented carbide, the smaller WC grain size leads to thinner binder films. Thus resistance to selective erosion of the soft binder phase by wear particles is reduced. It is reasonable to believe that the thinner binder also leads to better oxidation/corrosion properties since the properties of the binder at the WC interface is different from the pure metal.

From the above it seems that the main interest in developing finer sub-micron hardmetal, perhaps into the nanometer range, is to raise hardness, maximise attrition wear resistance and strength whilst as far as possible maintaining all other attributes at useful levels.

Thus improved wear resistance of cemented carbide is achieved by decreasing the tungsten carbide grain size to ultra fine and maintaining the binder content so that the hardness as is increased.

OBJECTS AND SUMMARY OF THE INVENTION

It is, thus, an object of the present invention to provide a tool for coldforming and drawing operations particularly in the manufacture of two-piece beverage aluminum or steel cans by the use of ultra fine grained cemented carbide giving better performance than prior art tools.

In one aspect of the invention there is provided an ultra fine cemented carbide comprising WC, a binder phase of Co, and less than about 1 wt-% grain growth inhibitors V and/or Cr, wherein the Co content is from about 5 to about 10 wt-% Co, and said cemented carbide has a Vickers hardness, HV30>2150-52*wt-% Co.

In another aspect of the invention, there is provided a method of manufacturing aluminium alloy or steel alloy cans including deep drawing and ironing steps, the improvement comprising using a tool for deep drawing and ironing made of WC, a binder phase of Co, and less than about 1 wt-% grain growth inhibitors V and/or Cr, wherein the Co content is from about 5 to about 10 wt-% Co, and said cemented carbide has a Vickers hardness, HV30>2150-52*wt-% Co.

In another aspect of the invention, there is provided a method of manufacturing aluminium alloy or steel alloy cans including an ironing step, the improvement comprising using a tool for ironing made of ultra fine cemented carbide comprising WC, a binder phase of Co, and less than about 1 wt-% grain growth inhibitors V and/or Cr, wherein the Co content is from about 5 to about 10 wt-% Co, and said cemented carbide has a Vickers hardness, HV30>2150-52*wt-% Co.

In yet another aspect of the invention, there is provided deep drawing and ironing tool comprising ultra fine cemented carbide comprising WC, a binder phase of Co, and less than about 1 wt-% grain growth inhibitors V and/or Cr, wherein the Co content is from about 5 to about 10 wt-% Co, and with a Vickers hardness, HV30>2150-52*wt-% Co. Particular improvement is achieved in the ironing operation. A combination of grain size and binder content that leads to the desired better performance is represented by 6 wt-% Co with ultra fine WC having a hardness about 2050 HV, i.e. higher hardness than the commonly used 6 wt-% Co binder grade that typical has the hardness of 1775 HV.

Examples of the tool and the cemented carbide according to the invention are found in FIG. 1 and FIG. 2 respectively.

DETAILED DESCRIPTION OF THE PREFERRED EMBODIMENTS

Figure 1:
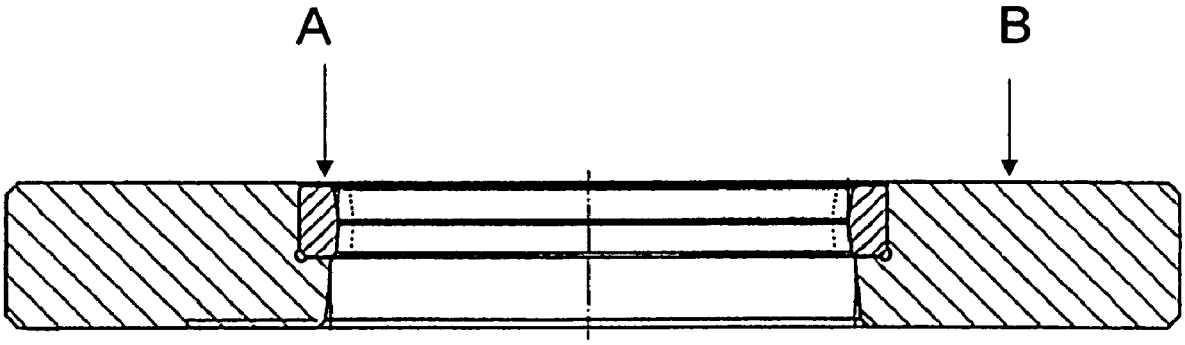
FIG. 1 shows an ironing die in which A=the cemented carbide die and B=the steel casing.
Figure 2:
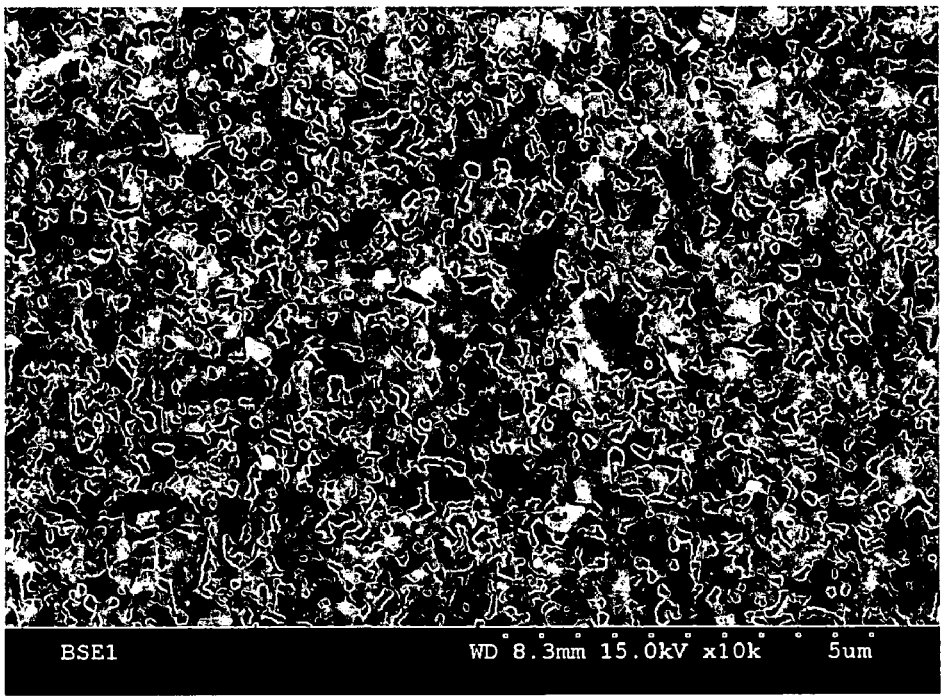
FIG. 2 shows in 10000 times magnification the microstructure of an ultra fine cemented carbide according to the present invention etched in Murakami. The structure contains WC and Co binder.

Thus the invention relates to the use of cemented carbide with ultra fine WC grain size and high hardness having improved wear resistance in coldforming and drawing operations particularly in the ironing process of aluminium and steel beverage can manufacturing. However the invention has broad applicability for use in manufacturing a variety of other shaped articles, particularly tubular casings, such as dry cell battery casings and aerosol cans.

In order to circumvent the well known difficulties in defining and measuring the tungsten carbide grain size of cemented carbide, and in this case to characterize "ultra fine cemented carbide", a Hardness/Binder content relation is used to characterize the cemented carbide according to the present invention. Use is made of the well known fact that the hardness of cemented carbide is dependent on the binder content and tungsten carbide grain size. As grain size or binder content decreases the hardness increases.

The invention thus relates to a cold forming tool of cemented carbide having a Co content between about 5 and about 10 wt-%, preferably from about 5.5 to about 8 wt-% and most preferably from 5.5 to about 7 wt-%, with less than about 1 wt-% grain growth inhibitors V and/or Cr and a hardness with the following relation between HV30 and Co-content in wt-%:

HV30>2150-52*wt-% Co, preferably HV30>2200-52*wt-% Co, more preferably HV30>2250-52*wt-% Co and most preferably the hardness HV30>1900.

In one embodiment, the cemented carbide has from about 5 to about 8 wt-% Co binder, less than about 1 wt-% grain growth inhibitors V and/or Cr and a hardness of >1850 for use as ironing die in the manufacturing of aluminum or steel beverage cans.

In another embodiment the cemented carbide has from about 5 to about 8 wt-% Co, less than about 1 wt-% grain growth inhibitors V and/or Cr with a hardness HV>1950.

In yet another embodiment the cemented carbide has 6-7 wt-% Co and less than about 1 wt-% grain growth inhibitors V and/or Cr and a hardness of HV 1950-2200.

The cemented carbide is made by conventional powder metallurgical techniques such as milling, pressing and sintering.

The invention also applies to the use of the cemented carbide according to the invention particularly for other cold-forming and drawing operations.

The invention is additionally illustrated in connection with the following examples, which are to be considered as illustrative of the present invention. It should be understood, however, that the invention is not limited to the specific details of the examples.

EXAMPLE 1

Ironing dies for 50 cl steel can production equipped with cemented carbide rings A and B:

A. WC-6 wt-% Co, submicron grain size, $Cr_3C_2$ as grain growth inhibitor with a hardness HV30 of 1775, prior art.

B. Ultra fine cemented carbide consisting of WC, 6 wt-% Co, and <1 wt-% V and Cr carbide as grain growth inhibitors, having a hardness HV30 of 2050, invention.

The tools were tested as the third ring (most severely damaged ring) in the 50 cl steel can production with the following results. Performance factor relates to the level of wear observed on the ring diameter after 100 000 cans produced. The rings according to the invention have in average only 74% wear compared to prior art.

Table 1 summarizes the average results from 24 rings tested for both sample A & B.

TABLE 1

| Sample | Performance Factor (Wear) |
|---|---|
| A. prior art | 100 |
| B. invention | 74 |

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. In a method of manufacturing aluminium alloy or steel alloy cans including deep drawing and ironing steps, the improvement comprising using a tool for deep drawing and ironing made of an ultra fine cemented carbide comprising WC, a binder phase of Co, and less than about 1 wt-% grain growth inhibitors V and/or Cr, wherein the Co content is from about 5 to about 8 wt-% Co, and said cemented carbide has a Vickers hardness, HV30>2150-52*wt-% Co, wherein the cemented carbide has a liquid-phase-sintered microstructure.

2. In the method of claim 1, wherein said cemented carbide has a Vickers hardness, HV30>2200-52*wt-% Co.

3. In the method of claim 1, wherein said cemented carbide has a Vickers hardness, HV30>2250-52*wt-% Co.

4. In the method of claim 1, wherein said cemented carbide has a Vickers hardness, HV30>1900.

5. In the method of claim 1, wherein said cemented carbide has a Co content of from about 5.5 to about 8 wt-%.

6. In the method of claim 1, wherein the cobalt content is from 6 to 7 wt-% Co.

7. In the method of claim 1, wherein the cobalt content is 6 wt-% Co and the Vickers hardness HV30>2050.

8. In the method of claim 1, wherein the cobalt content is 5.5 to 7 wt-% Co.

9. In a method of manufacturing aluminium alloy or steel alloy cans including an ironing step, the improvement comprising using a tool for ironing made of an ultra fine cemented carbide comprising WC, a binder phase of Co, and less than about 1 wt-% grain growth inhibitors V and/or Cr, wherein the Co content is from about 5 to about 8 wt-% Co, and said cemented carbide has a Vickers hardness, HV30>2150-52*wt-% Co, wherein the cemented carbide has a liquid-phase-sintered microstructure.

10. In the method of claim 9, wherein said tool has a Vickers hardness, HV30>2200-52*wt-% Co.

11. In the method of claim 9, wherein said tool has a Vickers hardness, HV30>2250-52*wt-% Co.

12. In the method of claim 9, wherein said tool has a Vickers hardness HV30>1900.

13. In the method of claim 9, wherein said cemented carbide has a Co content of from about 5.5 to about 8 wt-%.

14. In the method of claim 9, wherein the cobalt content is from 6 to 7 wt-% Co.

15. In the method of claim 9, wherein the cobalt content is 6 wt-% Co and the Vickers hardness HV30>2050.

16. In the method of claim 9, wherein the cobalt content is 5.5 to 7 wt-% Co.

17. Deep drawing and ironing tool comprising ultra fine cemented carbide comprising WC, a binder phase of Co, and less than about 1 wt-% grain growth inhibitors V and/or Cr, wherein the Co content is from about 5 to about 8 wt-% Co, and with a Vickers hardness, HV30>2150-52*wt-% Co, wherein the cemented carbide has a liquid-phase-sintered microstructure.

18. The tool of claim 17, wherein said tool has a Vickers hardness, HV30>2200-52*wt-% Co.

19. The tool of claim 17, wherein said tool has a Vickers hardness, HV30>2250-52*wt-% Co.

20. The tool of claim 17, wherein said tool has a Vickers hardness HV30>1900.

21. The tool of claim 17, wherein said cemented carbide has a Co content of from about 5.5 to about 8 wt-%.

22. The tool of claim 17, wherein the cobalt content is from 6 to 7 wt-% Co.

23. The tool of claim 17, wherein the cobalt content is 6 wt-% Co and the Vickers hardness HV30>2050.

24. The tool of claim 17, wherein the cobalt content is 5.5 to 7 wt-% Co.

* * * * *